US005098506A

United States Patent [19]

Brown et al.

[11] Patent Number: 5,098,506

[45] Date of Patent: Mar. 24, 1992

[54] METHOD AND APPARATUS FOR REMOVING FLOOR TILE MASTIC

[75] Inventors: Patrick K. Brown, Zionsville; R. Bruce Wallace, Indianapolis; Steven J. Leonard, Richmond, all of Ind.

[73] Assignee: BLW, Inc., Indianapolis, Ind.

[21] Appl. No.: 667,823

[22] Filed: Mar. 12, 1991

[51] Int. Cl.[5] ..... B32B 31/18

[52] U.S. Cl. ..... 156/344; 156/584; 15/50.1; 51/174; 51/177; 299/36

[58] Field of Search ..... 156/584, 351, 352, 356, 156/344; 299/36, 65; 51/174, 175, 176, 177; 15/357, 49.1, 50.1, 98; 404/90, 91, 112

[56] References Cited

U.S. PATENT DOCUMENTS

| | | | |
|---|---|---|---|
| 1,673,909 | 6/1928 | Gephart | 51/176 |
| 2,590,152 | 3/1952 | Buckey | 51/176 |
| 2,923,107 | 2/1960 | Biasoni | 51/177 |
| 2,954,653 | 10/1960 | Harvey | 51/177 X |
| 3,124,911 | 3/1964 | Vinella | 51/177 |
| 3,522,679 | 8/1970 | Sundberg | 51/177 X |
| 3,673,744 | 7/1972 | Oimoen | 51/177 |
| 3,934,377 | 1/1976 | Tertinek | 51/177 |
| 4,046,484 | 9/1977 | Holz, Sr. et al. | 404/112 |
| 4,317,314 | 3/1982 | Carlström et al. | 51/177 |
| 4,358,868 | 11/1982 | Cook, Jr. | 15/49 R |
| 4,542,551 | 9/1985 | Phillips | 15/49.1 |
| 4,981,548 | 1/1991 | Poll | 156/584 |
| 4,983,809 | 1/1991 | Malette et al. | 156/272.2 X |
| 5,018,890 | 5/1991 | May | 15/98 X |

FOREIGN PATENT DOCUMENTS

| | | | |
|---|---|---|---|
| 1-318660 | 12/1989 | Japan | 156/344 |

*Primary Examiner*—Caleb Weston
*Assistant Examiner*—Mark A. Osele
*Attorney, Agent, or Firm*—Locke Reynolds

[57] ABSTRACT

Apparatus for removing floor tile mastic from a floor includes a scouring unit enclosed within a shroud coupled to a plenum through which air can be drawn by a vacuum unit including a HEPA filter. Water or other liquid is delivered from a reservoir to the region of the scouring unit to wet any asbestos fibers in the floor tile mastic. The liquid supply and the flow of air through the filter are monitored and the operation of the scouring unit is inhibited at any time the supply of liquid or the flow of air falls below selected values.

18 Claims, 3 Drawing Sheets

METHOD AND APPARATUS FOR REMOVING FLOOR TILE MASTIC

BACKGROUND OF THE INVENTION

This invention relates broadly to methods and apparatus for removing previously applied floor tile mastic, and particularly with the removal of such mastic materials where those materials may contain asbestos or other hazardous waste.

For many years, the floors of various kinds of buildings such as schools, grocery stores, hospitals, factories and the like have been covered by floor tile so as to present an easily maintained decorative surface. The floor tile is typically composed of a matrix of particles and/or fibers bonded together by a continuous resinous component. The continuous component is typically a bituminous or vinyl base material. The particulate and/or fibrous filler can include a wide variety of materials including particles composed of the same or other resinous materials, extenders such as gypsum and mica, softening agents such as oils and waxes, and fibrous components to enhance the cohesive properties of the tile such as fiberglass and asbestos. Use of asbestos in floor tile has largely been curtailed due to the hazard presented by such substances. Nevertheless, a significant amount of tile already present in the environment does contain such asbestos fibers.

From time-to-time, it becomes desirable to replace an existant tile floor, or portions thereof, due to wear, to change of decorating colors, to go to a wholly new type of floor covering such as carpeting, or merely to eliminate the hazard presented by the asbestos containing materials. The removal of the tile from the floor can be done mechanically by inserting a tool between the floor tile and the floor. Typically, such a removal causes the tile to be broken into a number of pieces which is of little or no concern unless the tile contains asbestos fibers. Where the tile is asbestos fiber containing, such breaking of the tile might permit airborne release of asbestos fibers. Such removal of the tile also disturbs the mastic which bonds the tile to the floor. Such mastic may be contaminated with or otherwise contain asbestos fibers which again may be released into the air during such activity.

A number of statutes and agency regulations have been adopted to deal with the removal of asbestos containing floor tile to prevent the release of the asbestos into the environment. These statutes and regulations generally require that the work area be isolated from the environment, typically by the installation of plastic sheeting acting as a particulate barrier. Workers within the work area must be dressed in protective gear and wear respirators to prevent their own exposure to the material. Appropriate decontamination areas must be provided for the workers. The removed material must be disposed of in a compliant manner in order to minimize release of the asbestos into the environment. All of these steps substantially increase the time and cost of the removal of such tile. The complete removal of the mastic is further complicated by its tenacity to the floor itself thereby tempting many to delay the removal of such materials until absolutely required.

While certain advancements in the removal of asbestos tile have been developed such as those disclosed in U.S. Pat. No. 4,983,809, there has been little consideration for the development of a low cost means of removing asbestos containing or contaminated tile mastic from a floor subsequent to the tile removal. It is therefore a primary object of the present invention to provide a method and apparatus for removing tile mastic from a floor subsequent to the removal of the tile itself in a manner which eliminates the release of asbestos particles into the air.

SUMMARY OF THE INVENTION

In accordance with the present invention, a movable enclosure is provided which can be quickly and easily positioned to encompass any selected area of a floor where the safe removal of asbestos containing floor tile mastic is desired. The selected area of the floor within the enclosure is then contacted with a quantity of liquid sufficient to wet the asbestos containing material in the selected area. A flow of air is established into the enclosure adjacent to the floor and out of the enclosure through a filter means. The floor tile mastic on the floor is then scoured while the flow of air is continuing. The amount of liquid and air into and out of the enclosure is monitored continuously to insure the adequacy thereof. The scouring of the floor mastic is immediately inhibited in the event the amount of liquid or air falls below certain preselected values.

Most conveniently, this process is carried on by a single unit apparatus for removing floor tile mastic from a floor. The apparatus comprises a platform and support means for supporting the platform above a floor having floor tile mastic thereon. A motor means is mounted on the platform and a scouring means is coupled to the motor means for movement with respect to the platform and the floor. A conduit means is provided for supplying liquid to the floor in the vicinity of the scouring means. A shroud means surrounds the scouring means, and a plenum means is coupled to the shroud means to define a chamber through which air can be drawn. A vacuum means coupled to the plenum means draws air between the shroud means and the floor, and through the plenum means. A filter means coupled to the vacuum means filters the air passing through the plenum means. A first control means coupled to the conduit means and the motor means inhibits the operation of the motor means in the absence of liquid supplied to the floor in the vicinity of the scouring means. A second control means is coupled to the vacuum means and to the motor means for inhibiting operation of the motor means in the absence of a flow of air through the filter means.

One feature of the present invention is the provision of a small area movable enclosure within which all work is confined. The work within the movable enclosure is directed by workers, all of whom are located outside the enclosure area. This feature has the advantage of removing the worker from the hazardous material area thereby eliminating the need for awkward and bulky clothing, decontamination areas, and so forth. The removal of the worker from the hazardous work area permits a more timely and low cost removal of the mastic from the floor.

Another feature of the present invention is the control means for inhibiting the operation of the motor means in the absence of an adequate liquid supply to the floor. This feature has the advantage of insuring that any asbestos fiber or other potentially harmful material in the floor tile mastic will be thoroughly wetted with liquid thereby significantly reducing the chance for airborne release of the material. In a preferred embodiment, a liquid level alarm means is provided which can alert the operator of a low level of liquid thereby permitting the operator to replenish the same in advance of any difficulty.

Yet another feature of the present invention is a control means for inhibiting the operation of the motor means in the absence of an adequate flow of air through the filter means. This feature insures that any airborne release of material will be confined within the enclosure and will be drawn through the filtering means which is a high efficiency particulate (HEPA) filter system. Thus, the floor tile mastic removing apparatus cannot be operated unless the filtering equipment is operational to prevent release of asbestos fibers into the environment.

In the preferred embodiment, the second control means includes a plurality of manometers measuring the vacuum on either side of the filter means and circuit means for determining the efficiency of the filtering means. Such a control means directly ties the continual operation of the apparatus to the filtering efficiency thereby assuring that workers are not exposed to any hazardous situation. The control means also alerts the operator in advance of the need for maintenance of the filtering system of the equipment prior to any significant degradation in filtering performance.

Additional features and advantages of the invention will become apparent to those skilled in the art upon consideration of the following detailed description of a preferred embodiment exemplifying the best mode of carrying out the invention as presently perceived. The detailed description particularly refers to the accompanying drawings.

DESCRIPTION OF THE PREFERRED EMBODIMENTS

Figure 1:
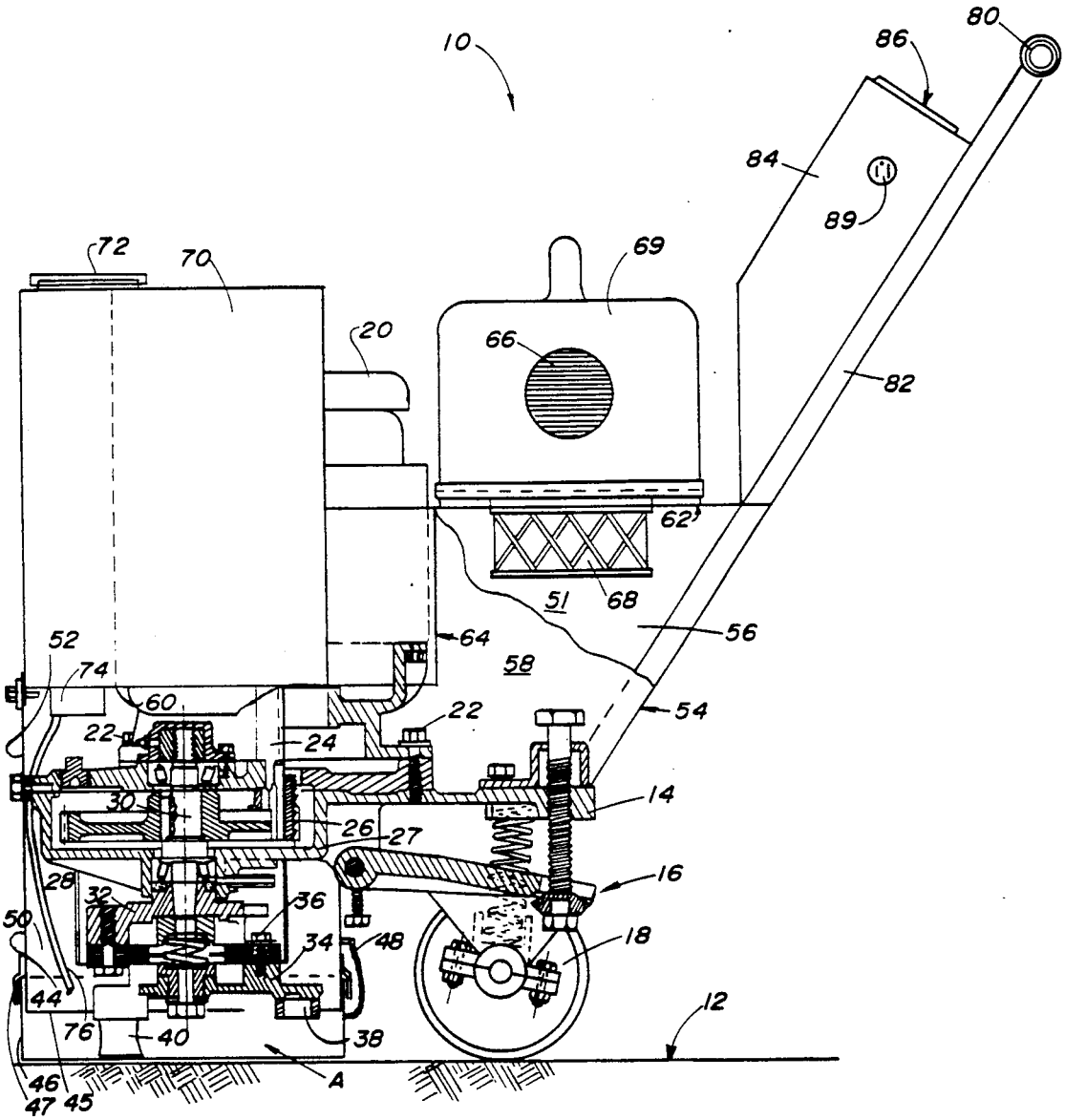
FIG. 1 is a side elevation view partially broken away of an apparatus constructed in accordance with the present invention.

A floor tile mastic removal apparatus 10 is shown in FIG. 1 positioned on a floor 12. The apparatus 10 comprises a main platform 14 supported on a trailing leaf suspension system of known design on a pair of wheels 18 (only one of which is shown). A motor 20 is fixed to the platform by a plurality of fasteners 22 such that the driven shaft 24 of the motor projects downwardly to engage spur gear 26 within gear housing 27. The spur gear 26 engages one or more driven gears 28 each of which are keyed for rotation about a corresponding driven shaft 30. A lower end of the driven shaft 30 is fixed to a driving spider 32 which is in turn connected to a drive head 34 through wobble plate 36. The drive head 34 includes a plurality of downwardly facing cups 38 adapted to receive replaceable scouring elements 40.

An inner shroud 42 projects downwardly from the platform to surround the spider 32 and wobble plate 36. An outer shroud 44 projects downwardly from the platform 14 to surround the inner shroud 42 and the area of the scouring head 34. A skirt 46 surrounds the lower perimeter 45 of shroud 44 and is vertically movable with respect to shroud 44 over a limited distance by virtue of an elastic band 47 confining the space between the skirt 46 and the shroud 44 around the entire circumference of shroud 44 and skirt 46 with a retaining chain 48.

The space existent between inner shroud 42 and outer shroud 44 defines a plenum 50 through which air can be drawn upwardly past the gear enclosing portion 27 of platform 14 to an enclosed volume or chamber 51 extending from front wall 52 rearwardly to a rear wall 54. The chamber 51 is further defined by side walls 56 and 58, and is completed by platform 14, a forward top wall 60, a rearward top wall 62 and a vertical partition wall 64 joining walls 60 and 62.

A vacuum means 69 having an exhaust outlet 66 rests on and is coupled to the top wall 62. The vacuum means 64 draws air through an opening 63 in top wall 62. The air is drawn below the skirt 46 in the direction of arrow "A" upward through plenum 50, into the chamber 51, into contact with and through filter 68. The filter 68 is a high efficiency particulate (HEPA) filter certified for use in connection with the handling of asbestos materials and intended to retain any airborne asbestos particles within the enclosed chamber 51. It will be appreciated that the filter 68 is a replaceable element which must be maintained in suitable working order for the apparatus 10 to perform the intended function. The volume of air drawn upward by the vacuum means 64 must be sufficient to insure an inward flow of air around the entire perimeter of skirt 46 during operation of the apparatus 10 thereby inhibiting any outward dispersal of particulate matter or airborne materials.

A liquid reservoir 70 is mounted to surround the forward perimeter of motor 20 and includes a cap 72 to permit the introduction of liquid into the reservoir. In general, the liquid employed in the operation of the present invention is merely water but can include certain surfactants which might enhance the fiber wetting capacity of the water but at the same time not adversely affect the character of the scouring elements 40 as they work on the mastic on floor 12. A control valve 74 controls the delivery of liquid from the reservoir 70 to conduit 76. The conduit 76 projects downwardly from valve 74 into the immediate vicinity of the drive head 34 to supply liquid to the floor in the vicinity of the scouring operation.

The apparatus 10 is manually directed to a desired location through the use of a handle 80 fixed to platform 14 by means of standards 82. An electrical control housing 84 is fixed to standards 82 and contains the various electrical control circuitry for the apparatus. An instrument panel 86 is provided immediately adjacent to handles 80 so as to be within the convenient reach of an operator and to be positioned for easy and continuous reference by the operator.

Figure 2:
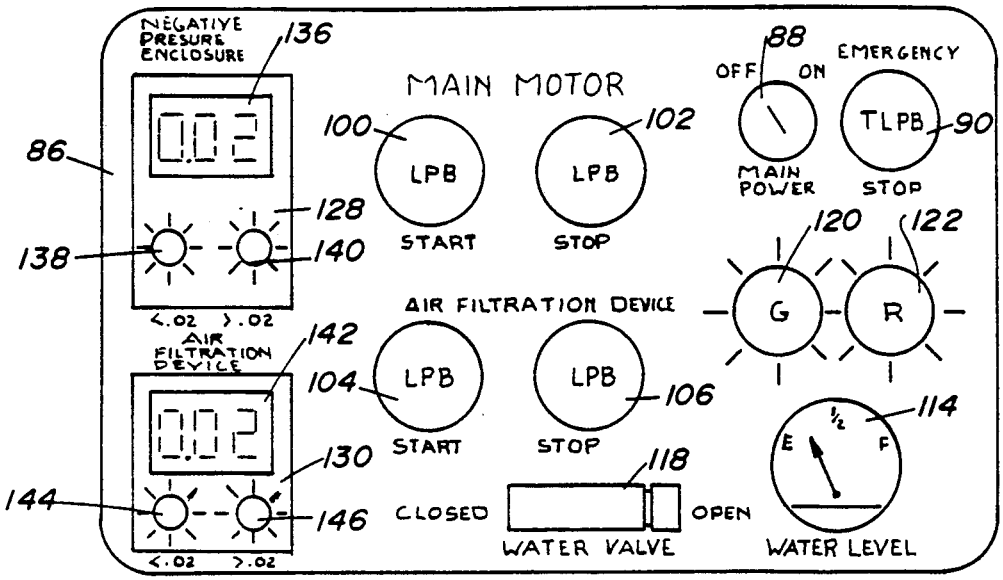
FIG. 2 is an elevation view of the face of the electrical control panel.
Figure 3:
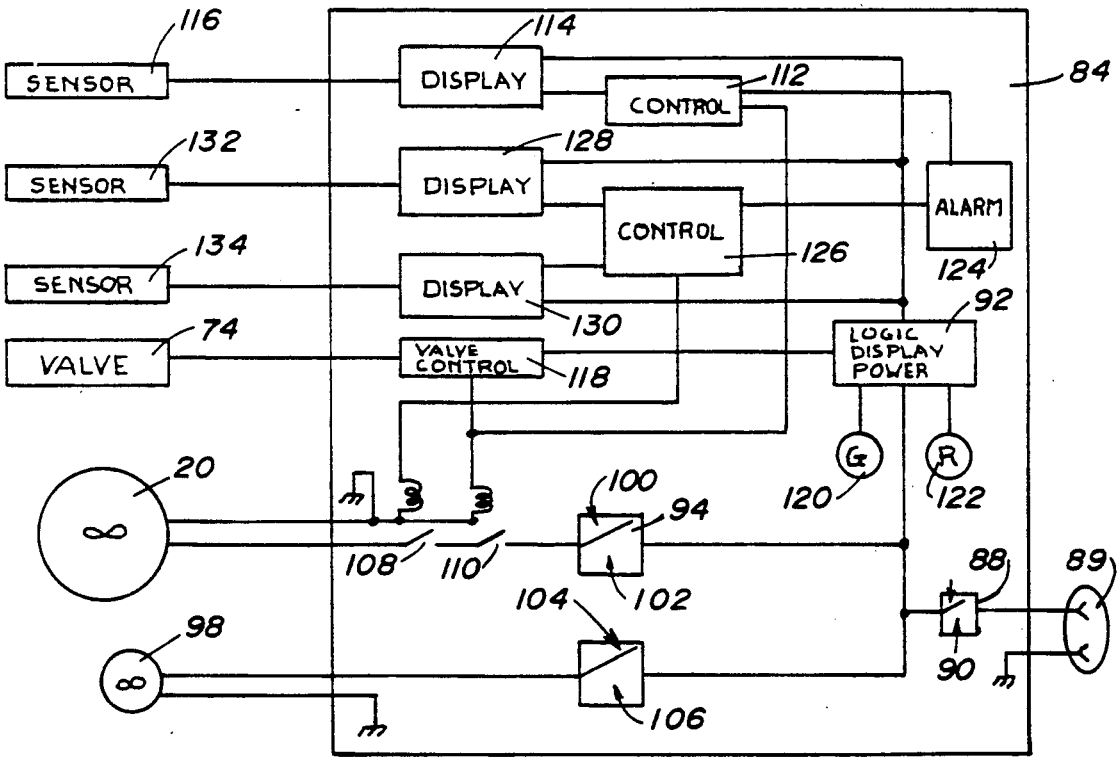
FIG. 3 is a schematic line diagram showing the various control means for the present apparatus.

The control panel 86 is shown in FIG. 2 while the circuitry below that panel is shown in FIG. 3. A main on/off power switch 88 connects the circuit with an outside source of power through power input jack 89. The main power switch includes an emergency stop push button 90 connected to the main power switch 88 to allow quick shut-off of the apparatus 10 in the event of an emergency. When the main power switch 88 is turned on, power is permitted to flow to a logic display power supply 92, with switch 94 controlling the delivery of power to motor 20, and switch 96 controlling the delivery of power to motor 98 of the vacuum means 64.

The switch 94 controlling power to motor 20 is actuated by start push button 100 and by stop push button 102. The delivery of power to the motor 98 by switch 96 is similarly controlled by start push button 104 and by stop push button 106. It is to be noted that with the main power switch 88 on, power can be delivered directly to motor 98 through actuation of the start push button 104. On the other hand, actuation of start push button 100 will not deliver power to motor 20 unless relays 108 and 110 are appropriately actuated.

Relay 110 is connected to a first control means 112 which is in turn connected through display 114 to a water level sensor 116 located within reservoir 70. The flow of water from reservoir 70 is controlled by valve control 118 and light signals 120 and 122, which are respectively green and red, indicate the delivery of water from reservoir 70 through conduit 76. As long as sensor 116 senses an adequate display of water within reservoir 70 and valve control 118 is situated so as to guarantee a flow of water, then relay 110 is maintained in a closed position permitting power to flow through to motor 20. In the event the valve control is moved to a position providing an inadequate flow of liquid or sensor 116 senses an inadequate supply of liquid, then relay 110 opens depriving motor 20 of power and sounding alarm 124.

Relay 108 is connected to a second control means 126 which is in turn connected through displays 128 and 130 to manometer sensors 132 and 134. Sensor 132 is located within chamber 51 to sense that pressure within that chamber and provide information to the display 128 relative to that pressure. The display 128 includes a visual read out 136 of the pressure as well as red and green lights 138 and 140 indicating unsatisfactory and satisfactory performance, respectively.

In a similar manner, sensor 134 is situated within the housing of the vacuum means 64 above filter 68 to sense the air pressure on the opposite side of filter 68 from that sensed by sensor 132. Display 130 coupled to sensor 134 includes a visual display 142 of the pressure within the housing of vacuum means 64 and red and green lights 144 and 146 indicating satisfactory and unsatisfactory performance of the vacuum means 64, respectively.

An output from display 128 and 130 is coupled to the control means 126 providing the control means with the information relating to the pressure on both sides of filter 68. As long as the vacuum in enclosure 51 is adequate and the difference in vacuum between enclosure 51 and vacuum means 64 is not so large as to indicate the need for a change of filter 68, then relay 108 is maintained in a closed position. In the event that either sensor 132 or 134 senses too small a vacuum, or the difference in vacuum sensed indicates a need for a change in filter 68, then relay 108 is opened depriving motor 20 of power and alarm 124 is actuated.

Figure 4:
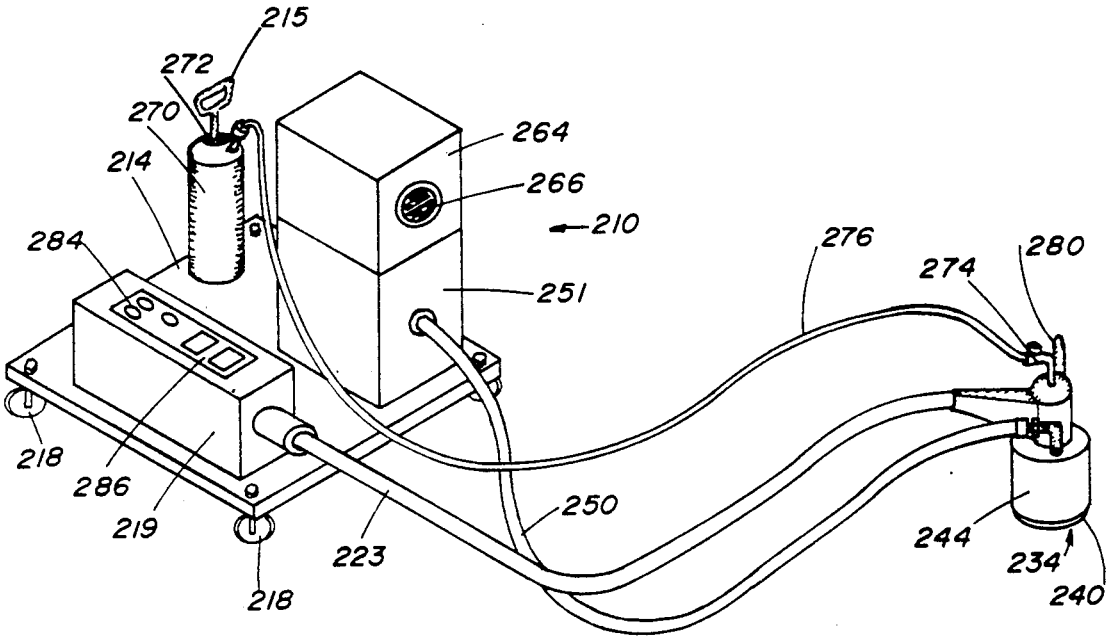
FIG. 4 is a perspective view of an alternative embodiment of the present invention.

A second embodiment of a floor tile mastic removal apparatus 210 is shown in FIG. 4. The apparatus 210 comprises a main platform 214 supported on a plurality of wheels 218. A motor is situated within housing 219 which is fixed to the platform 214. The driven shaft of the motor is coupled to a flexible shaft 223 which extends outwardly to a scouring head 234 within shroud 244. The scouring head 234 includes a single replaceable scouring element 240. The shroud 244 includes a handle 280 which is used to move the scouring head 234 to a desired work location remote from the platform 214.

The space existent between the scouring element 240 and shroud 244 defines a plenum through which air can be drawn through vacuum line 250 to an enclosed volume or chamber 251 on platform 214. A vacuum means 264 having an exhaust outlet 266 rests on and is coupled to the top of chamber 251. The vacuum means 264 draws air in the chamber 251 into contact with and through a filter, a high efficiency particulate (HEPA) filter certified for use in connection with the handling of asbestos materials and intended to retain any airborne asbestos particles within the enclosed chamber 251. It will be appreciated that the filter is a replaceable element which must be maintained in suitable working order for the apparatus 210 to perform the intended function. The volume of air handled by the vacuum means 264 must be sufficient to insure an inward flow of air around the entire perimeter of shroud 244 during operation of the apparatus 210 thereby inhibiting any outward dispersal of particulate matter or airborne materials.

A liquid reservoir 270 is mounted on platform 214 and includes means 215 for pressurizing the liquid reservoir 270 and a cap 272 to permit the introduction of liquid into the reservoir. A conduit 276 extends from the reservoir 270 to a valve 274 in the immediate vicinity of the scouring head 234 to supply liquid to the floor in the vicinity of the scouring operation. The control valve 274 controls the delivery of liquid from the reservoir 270 through conduit 276.

Figure 5:
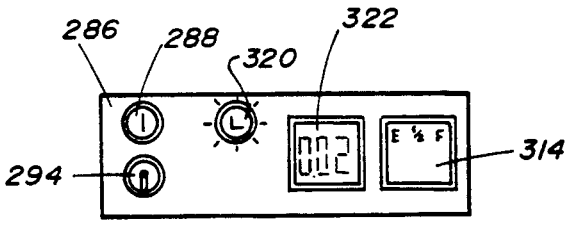
FIG. 5 is an elevation view of the control panel on the embodiment shown in FIG. 4.

An electrical control unit 284 is fixed to housing 219 and contains the various electrical control circuitry for the apparatus. An instrument panel 286 is provided within the convenient reach of, and for easy and continuous reference by, the operator. The electrical control panel 286, shown in FIG. 5, is coupled to circuitry similar to that shown in FIG. 3. A main on/off power switch 288 connects the circuit with an outside source of power. When the main power switch 288 is turned on, power is permitted to flow to the circuitry within housing 219 including switch 294 controlling the delivery of power to the motor driving the flexible shaft 223 coupled to the scouring head 234. It is to be noted that with the main power switch 288 on, power can be delivered directly to the motor driving the vacuum means 264. On the other hand, the delivery of power to the motor driving the flexible shaft 223 coupled to the scouring head 234 will not occur unless relays or other control means similar that discussed in connection with the first embodiment of the invention are appropriately actuated.

A first control means is provided which is connected through display 314 to a water level sensor located within reservoir 270. The flow of water from reservoir 270 through conduit 276 controlled by valve control 274 is indicated by light 320. In the event the valve 274 is moved to a position providing an inadequate flow of liquid or an inadequate supply of liquid is indicated to exist within reservoir 270, power is prevented from flowing to the motor driving the flexible shaft 223 and an alarm is sounded.

A second control means is provided which is connected through display 328 to manometer sensors located within chamber 251 and within the housing of the vacuum means 264 to sense the air pressure on the opposite sides of the HEPA filter. The display 328 indicates the pressure within the chamber 251. In the event that either sensor senses too small a vacuum, or the difference in vacuum sensed indicates a need for a change in filter, then power is prevented from flowing to the motor driving the flexible shaft 223 and an alarm is sounded.

Although the invention has been described in detail with reference to certain preferred embodiments, variations and modifications exist within the scope and spirit of the invention as described and as defined in the following claims.

What is claimed is:

1. Apparatus for removing floor tile mastic from a floor comprising: a platform and support means for supporting the platform above a floor having floor tile mastic thereon, motor means mounted on the platform, scouring means coupled to the motor means for movement with respect to the platform and the floor, conduit means for supplying liquid to the floor in the vicinity of the scouring means, shroud means for surrounding the scouring means, plenum means coupled to the shroud means defining a chamber through which air can be drawn, vacuum means coupled to the plenum means for drawing air below the shroud means and through the plenum means, filter means coupled to the vacuum means for filtering the air passing through the plenum means, first control means coupled to the conduit means and the motor means for inhibiting operation of the motor means in the absence of liquid supply to the floor in the vicinity of the scouring means, and second control means coupled to the vacuum means and the motor means for inhibiting operation of the motor means in the absence of a flow of air through the filter means.

2. The apparatus of claim 1 further comprising reservoir means mounted on the platform for containing a supply of liquid, and valve means for controlling delivery of liquid from the reservoir means to the conduit means.

3. The apparatus of claim 2 further comprising liquid alarm means responsive to the level of liquid in the reservoir means and coupled to the first control means for indicating an undesirably low level of liquid within the reservoir means.

4. The apparatus of claim 1 wherein the shroud means comprises: an upper member fixed to the platform, a lower member movable with respect to the upper member, seal means sealing the upper and lower members together, and means for supporting the lower member to float adjacent to the floor.

5. The apparatus of claim 1 further comprising main control means coupled to the first and second control means for controlling delivery of power to the motor means and the vacuum means.

6. The apparatus of claim 1 further comprising a first manometer means on a first side of the filter means, a second manometer means on a second side of the filter means, and circuit means connecting the first and second manometer means for indicating the efficiency of the filter means.

7. The apparatus of claim 1 further comprising flexible shaft means coupling the motor means to the scouring means for allowing manipulation of the scouring means separate from the platform.

8. Apparatus for removing floor tile mastic from a floor comprising: a platform and support means for supporting the platform above a floor having floor tile mastic thereon, motor means mounted on the platform, scouring means coupled to the motor means for movement with respect to the platform and the floor, conduit means for supplying liquid to the floor in the vicinity of the scouring means, shroud means for surrounding the scouring means, plenum means coupled to the shroud means defining a chamber through which air can be drawn, vacuum means coupled to the plenum means for drawing air below the shroud means and through the plenum means, filter means coupled to the vacuum means for filtering the air passing through the plenum means, a first manometer means on a first side of the filter means, a second manometer means on a second side of the filter means, and circuit means connecting the first and second manometer means for indicating the efficiency of the filter means, first control means coupled to the conduit means and the motor means for inhibiting operation of the motor means in the absence of liquid supply to the floor in the vicinity of the scouring means, liquid alarm means responsive to the level of liquid in the reservoir means and coupled to the first control means for indicating an undesirably low level of liquid within the reservoir means, second control means coupled to said circuit means and the motor means for inhibiting operation of the motor means in the absence of a predetermined flow of air through the filter means, and main control means coupled to the first and second control means for controlling delivery of power to the motor means and the vacuum means.

9. The apparatus of claim 8 further comprising flexible shaft means coupling the motor means to the scouring means for allowing manipulation of the scouring means separate from the platform, and wherein said conduit means is substantially coextensive with the flexible shaft means between the platform and the scouring means.

10. The apparatus of claim 9 further comprising vacuum hose means coupling the shroud means to the plenum means for directing air therebetween, the vacuum hose means being substantially coextensive with the flexible shaft means between the platform and the shroud means.

11. The apparatus of claim 8 further comprising reservoir means mounted on the platform above a portion of said plenum means for containing a supply of liquid, and valve means for controlling delivery of liquid from the reservoir means through said conduit means to the floor in the vicinity of the scouring means.

12. The apparatus of claim 8 wherein the plenum means further comprises a collection manifold situated above the platform and below the filter means for collecting matter picked up by the air drawn through the plenum and filter means.

13. The apparatus of claim 8 wherein the filter means comprises a HEPA filter.

14. The apparatus of claim 8 further comprising a handle assembly fixed to the platform having an upper end permitting manipulation of the apparatus, and a control panel located adjacent to handle assembly upper end including said control means.

15. A method for the safe removal of asbestos-contaminated floor tile mastic from a floor comprising the steps of:

providing an enclosure movable with respect to the floor to selected areas thereof, contacting the selected area of the floor under the enclosure with a quantity of liquid sufficient to wet any asbestos fibers in the selected area, establishing a flow of air into the enclosure adjacent to the floor and out of the enclosure through a filter means, scouring the floor tile mastic on the floor under the enclosure while the flow of air is continuing, monitoring the amount of liquid and air into and out of the enclosure, and inhibiting the scouring of the floor in the event the amount of liquid or air falls below selected values.

16. The method of claim 15 further comprising the step of: collecting all material scoured from the floor for later disposal.

17. The method of claim 15 further comprising the step of: continuously moving the enclosure with respect to the floor to enlarge the total area being scoured.

18. The method of claim 15 further comprising the step of: monitoring the filtering efficiency of the filtering means and periodically replacing the filtering means when the efficiency falls below a selected criterion.

* * * * *